US007992765B2

(12) United States Patent
Brand

(10) Patent No.: US 7,992,765 B2
(45) Date of Patent: Aug. 9, 2011

(54) CARTON WITH DISPENSER

(75) Inventor: Kirsten Laura Brand, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 724 days.

(21) Appl. No.: 11/685,393

(22) Filed: Mar. 13, 2007

(65) Prior Publication Data

US 2007/0210144 A1 Sep. 13, 2007

Related U.S. Application Data

(60) Provisional application No. 60/781,871, filed on Mar. 13, 2006.

(51) Int. Cl.
*B65D 17/00* (2006.01)
*B65D 5/72* (2006.01)

(52) U.S. Cl. ..... 229/122.1; 229/242

(58) Field of Classification Search ..... 229/122.1, 229/242, 237, 925, 243, 924; 221/305; 206/815
See application file for complete search history.

(56) References Cited

U.S. PATENT DOCUMENTS

| | | | |
|---|---|---|---|
| 1,925,102 | A | 9/1933 | Levkoff |
| 2,005,924 | A | 6/1935 | Wilson |
| 2,067,749 | A | 1/1937 | Zimmerman et al. |
| 2,115,673 | A | 4/1938 | Stompe |
| 2,299,027 | A | 10/1942 | Novak |
| 2,669,351 | A | 2/1954 | Carson et al. |
| 2,754,047 | A | 7/1956 | Schmidt et al. |
| 3,078,032 | A | 9/1963 | Robinson et al. |
| 3,128,010 | A | 4/1964 | Forrer |
| 3,133,634 | A | 5/1964 | Bozdar |
| 3,178,242 | A | 4/1965 | Ellis et al. |
| 3,228,582 | A | 1/1966 | Osberg |
| 3,263,861 | A | 8/1966 | Carr |
| 3,265,283 | A | 8/1966 | Farquhar |
| 3,300,115 | A | 1/1967 | Schauer |
| 3,332,594 | A | 7/1967 | De Capua |
| 3,346,167 | A | 10/1967 | Schmidt |
| 3,356,279 | A | 12/1967 | Root |
| 3,517,858 | A | 6/1970 | Farquhar |
| 3,533,549 | A | 10/1970 | Gilchrist |
| 3,540,581 | A | 11/1970 | Kollnis |
| 4,155,449 | A | 5/1979 | Bryne |
| 4,214,660 | A | 7/1980 | Hunt, Jr. |
| 4,222,485 | A | 9/1980 | Focke |
| 4,256,226 | A | 3/1981 | Stone |
| 4,318,474 | A | 3/1982 | Hasegawa |
| 4,364,509 | A | 12/1982 | Holley, Jr. et al. |
| 4,375,258 | A | 3/1983 | Crayne et al. |
| 4,376,509 | A | 3/1983 | Schaffer |
| 4,378,877 | A | 4/1983 | Botterman et al. |
| 4,396,143 | A | 8/1983 | Killy |

(Continued)

FOREIGN PATENT DOCUMENTS

| | | | |
|---|---|---|---|
| CA | 873185 | A1 | 6/1971 |

(Continued)

*Primary Examiner* — Justin M Larson
*Assistant Examiner* — Christopher Demeree
(74) *Attorney, Agent, or Firm* — Womble Carlyle Sandridge & Rice, PLLC

(57) ABSTRACT

A carton and blank for forming the carton having a dispenser for dispensing cylindrical containers or other types of articles. The dispenser has a removable dispenser panel that is accessed from an access panel foldably attached to the carton.

35 Claims, 6 Drawing Sheets

U.S. PATENT DOCUMENTS 4,417,655 A 11/1983 Forbes, Jr.
4,417,661 A 11/1983 Roccaforte
4,577,762 A 3/1986 Kuchenbecker
4,605,128 A 8/1986 Rieke
4,658,984 A 4/1987 Brunner
4,817,866 A 4/1989 Wonnacott
4,890,440 A 1/1990 Romagnoli
4,949,845 A 8/1990 Dixon
4,974,771 A 12/1990 Lavery
5,101,642 A 4/1992 Alexandrov
5,137,211 A 8/1992 Summer et al.
5,219,229 A 6/1993 Sengewald
5,249,681 A 10/1993 Miller
5,425,474 A 6/1995 Dalea et al.
5,482,185 A 1/1996 McNaughton
5,505,372 A 4/1996 Edson et al.
5,577,612 A 11/1996 Chesson et al.
5,597,114 A 1/1997 Kramedjian et al.
5,622,309 A 4/1997 Matsuda et al.
5,664,683 A 9/1997 Brody
5,690,213 A 11/1997 Matsumura
5,690,230 A 11/1997 Griffith
5,794,778 A 8/1998 Harris
5,826,783 A 10/1998 Stout
5,875,961 A 3/1999 Stone et al.
5,881,884 A 3/1999 Podosek
5,921,398 A 7/1999 Carroll
5,924,559 A 7/1999 Carrel et al.
5,927,498 A 7/1999 Saam
6,050,402 A 4/2000 Walter
6,176,419 B1 1/2001 Holley, Jr.
6,283,293 B1 9/2001 Lingamfelter
6,409,077 B1 6/2002 Telesca et al.
D459,927 S 7/2002 Flowers et al.
6,478,219 B1 11/2002 Holley, Jr.
6,484,903 B2 11/2002 Spivey et al.
6,550,615 B2 4/2003 Lingamfelter
6,557,699 B1 5/2003 Focke et al.
6,578,736 B2 6/2003 Spivey
6,604,677 B1 8/2003 Sutherland et al.
6,669,083 B2 12/2003 Bates
6,715,639 B2 4/2004 Spivey
6,752,262 B1 6/2004 Boriani et al.
6,789,673 B2 9/2004 Lingamfelter
6,866,186 B2 3/2005 Fogle et al.
6,866,188 B2 3/2005 Harrelson
6,896,130 B2 5/2005 Theelen
6,902,104 B2 6/2005 Holley, Jr. et al.
6,918,487 B2 7/2005 Harrelson
6,929,172 B2 8/2005 Bates et al.
6,945,450 B2 9/2005 Rusnock
6,968,992 B2 11/2005 Schuster
6,969,172 B2 11/2005 Actis-Datta
6,974,072 B2 12/2005 Harrelson
6,991,107 B2 1/2006 Harrelson
6,997,316 B2 2/2006 Sutherland
7,000,803 B2 2/2006 Miller
7,104,435 B2 9/2006 Holley, Jr.
7,134,593 B2 11/2006 Harrelson
7,168,558 B2 1/2007 Harrelson
7,225,930 B2 6/2007 Ford et al.
7,240,789 B2 7/2007 Sutherland
2002/0029991 A1 3/2002 Lingamfelter
2002/0070139 A1 6/2002 Bates
2002/0088820 A1 7/2002 Spivey
2002/0088821 A1 7/2002 Spivey et al.
2002/0185499 A1 12/2002 Harrelson et al.
2003/0141313 A1 7/2003 Bates
2003/0150759 A1 8/2003 White, Jr.
2003/0192907 A1 10/2003 Bates
2004/0060972 A1 4/2004 Harrelson
2004/0089575 A1 5/2004 Lingamfelter
2004/0089671 A1 5/2004 Miller
2004/0099558 A1 5/2004 Oliff et al.
2004/0155098 A1 8/2004 Harrelson
2004/0188277 A1 9/2004 Auclair
2004/0188300 A1 9/2004 Sutherland
2005/0023170 A1 2/2005 Lingamfelter
2005/0092820 A1 5/2005 Chekroune
2005/0103650 A1 5/2005 Auclair et al.
2005/0126947 A1 6/2005 Holley, Jr.
2005/0178791 A1 8/2005 Miller
2005/0189405 A1 9/2005 Gomes et al.
2005/0224565 A1* 10/2005 Holley ..... 229/242
2006/0054522 A1 3/2006 Kline et al.
2006/0091193 A1* 5/2006 DeBusk et al. ..... 229/122.1
2006/0118606 A1 6/2006 Holley, Jr. et al.
2006/0131370 A1* 6/2006 Bates ..... 229/122
2006/0175386 A1 8/2006 Holley, Jr.

FOREIGN PATENT DOCUMENTS

DE 202 13 450 U1 11/2002
EP 0 066 029 A1 12/1992
FR 2 549 010 1/1985
GB 2 264 101 A 8/1993
GB 0202809 2/2002
WO WO 96/29260 9/1996
WO WO 99/64301 12/1999
WO WO 00/03937 1/2000
WO WO 02/47990 A2 6/2002
WO WO 2004/043790 A2 5/2004
WO WO 2005/051781 A1 6/2005
WO WO 2006/50210 A2 5/2006
WO WO 2006/050316 A1 5/2006

* cited by examiner

CARTON WITH DISPENSER

CROSS-REFERENCE TO RELATED APPLICATIONS

This application claims the benefit of U.S. Provisional Application No. 60/781,871 which was filed on Mar. 13, 2006. The entire content of the above-referenced provisional application is hereby incorporated by reference as if presented herein in its entirety.

BACKGROUND OF THE INVENTION

The present invention generally relates to cartons for holding and dispensing cylindrical containers or other types of articles.

Fully enclosed cartons that are capable of carrying containers have been used in the past that have a dispenser for dispensing the containers one at a time. Dispensers have been provided with removable dispenser panels at various locations in the carton which include opening holes or tabs on the dispenser for grasping the dispenser panel and removing it from the carton. It is desired to provide a carton with a dispenser panel that can be easily grasped and removed from the carton.

SUMMARY OF THE INVENTION

In general, one aspect of the invention is directed to a carton for holding a plurality of containers. The carton comprises a carton for containing a plurality of articles. The carton comprises a plurality of panels that extends at least partially around an interior of the carton. The plurality of panels comprises a top panel, a bottom panel, a first side panel, and a second side panel. At least two end flaps respectively foldably attached to respective panels of the plurality of panels. The end flaps are overlapped with respect to one another and thereby at least partially close an end of the carton. A dispenser allows removal of articles from the carton. The dispenser comprises a dispenser panel that is at least partially defined by a tear line in the carton and is for being at least partially removed for at least further opening a dispenser opening. In the closed end, the tear line comprises an upper tear line and a lower tear line, the upper and lower tear lines being spaced apart and respectively extending across the closed end. An access panel in at least one of the side panels is for being inwardly folded to initiate removal of the dispenser panel.

In another aspect, the invention is generally directed to a blank for forming a carton. The blank comprises a plurality of panels. The plurality of panels comprises a top panel, a bottom panel, a first side panel, and a second side panel. At least two end flaps respectively foldably attached to respective panels of the plurality of panels. Dispenser features comprise at least one dispenser panel that is at least partially defined by a tear line for at least partially separating the dispenser panel from the blank. The tear line comprises two spaced apart tear lines in the at least two end flaps. The two tear lines respectively extending across the at least two end flaps. An access panel in at least one of the side panels is for being inwardly folded to initiate removal of the dispenser panel.

In another aspect, the invention is generally directed to a method of opening a carton. The method comprises providing a carton having a plurality of panels that extends at least partially around an interior of the carton. The plurality of panels comprises a top panel, a bottom panel, a first side panel, a second side panel, and end flaps respectively foldably attached to respective panels of the plurality of panels. The end flaps are overlapped with respect to one another and thereby at least partially form a closed end of the carton. A dispenser comprises a dispenser panel at least partially defined by a tear line in the carton. The tear line comprises an upper tear line and a spaced-apart lower tear line, each of the upper and lower tear lines extend across the closed end. An access panel is in at least one of the side panels. The method further comprises inwardly folding the access panel to allow access to the dispenser panel and grasping the dispenser panel and at least partially separating the dispenser panel from the carton by at least partially tearing the carton along the upper and lower tear lines to create a dispenser opening in the carton.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWINGS

Corresponding reference characters indicate corresponding parts throughout the several views of the drawings.

DETAILED DESCRIPTION OF THE ILLUSTRATED EMBODIMENTS

The present invention generally relates to a dispenser for a carton. The present invention can be used, for example, in cartons that contain articles or other products such as, for example, food and beverages. The articles can also include beverage containers such as, for example, cans, bottles, PET containers, or other containers such as those used in packaging foodstuffs. For the purposes of illustration and not for the purpose of limiting the scope of the invention, the following detailed description describes generally cylindrical beverage containers as disposed within the carton embodiments. In this specification, the terms "lower," "bottom," "upper" and "top" indicate orientations determined in relation to fully erected cartons.

Figure 1:
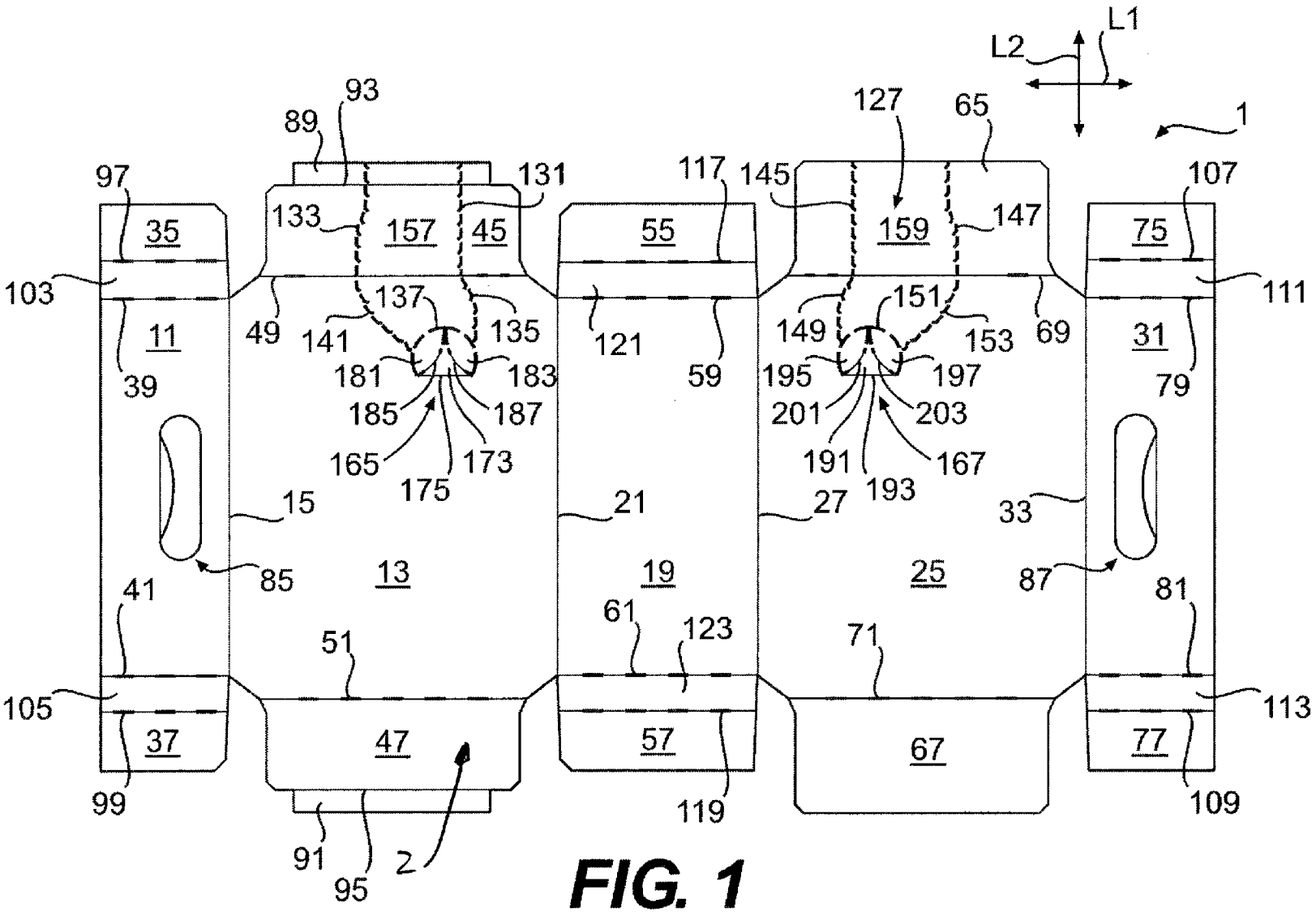
FIG. 1 is a plan view of a blank used to form a carton according to a first embodiment of the invention.
Figure 2:
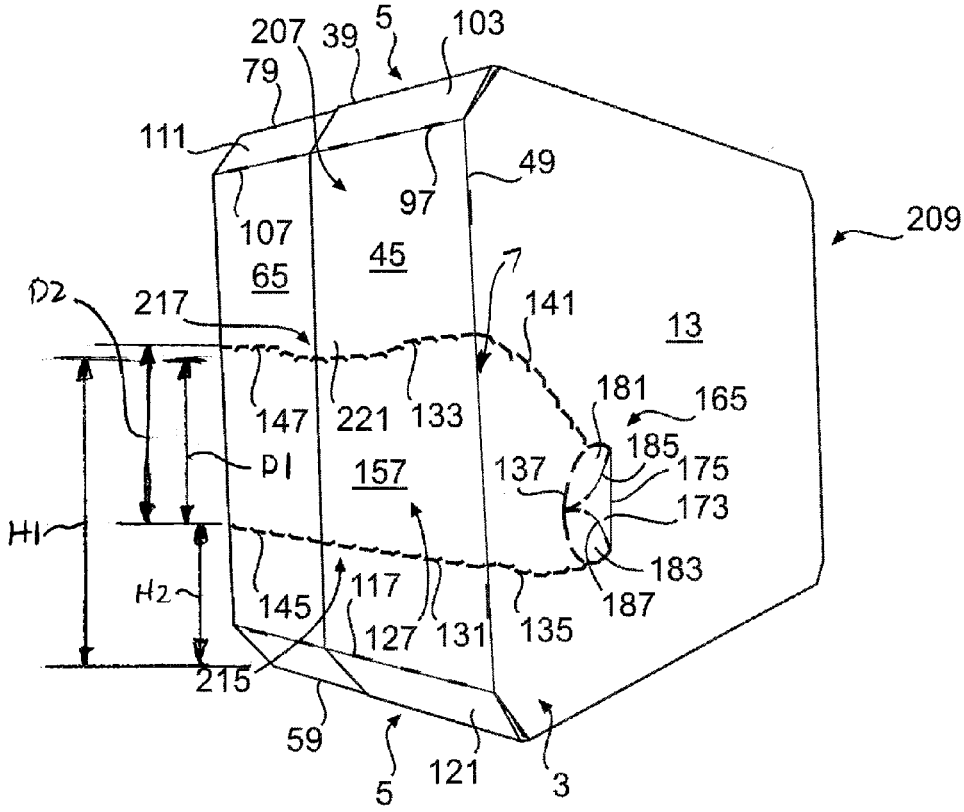
FIG. 2 is a front perspective of the carton.

FIG. 1 is a plan view of a first, exterior side 2 of a blank, generally indicated at 1, used to form a carton, generally indicated at 3 (FIGS. 2-7), according to a first embodiment of the invention. The blank 1 has a longitudinal axis L1 and a lateral axis L2. As shown in FIG. 2, the carton 3 is generally rectangular in shape and is configured for holding twelve cylindrical containers C (FIG. 7) in a 3×4 arrangement. In the illustrated embodiment, the carton 3 has oblique corners, generally indicated at 5, but it is understood that the carton 3 may be otherwise shaped and may hold the same or different quantity of containers C in other configurations (e.g., 2×6, 3×6, 2×6×2, 3×4×2, etc.) without departing from the scope of this invention. As explained in more detail below, the carton 3 has a dispenser, generally indicated at 7, for allowing access to the containers C in the carton 1.

The blank 1 comprises a first top flap or panel 11 foldably connected to a first side panel 13 at a first lateral fold line 15, a bottom panel 19 connected to the first side panel 13 at a second lateral fold line 21, a second side panel 25 foldably connected to the bottom panel 19 at a third lateral fold line 27, and a second top flap or panel 31 foldably connected to the second side panel 25 at a fourth lateral fold line 33.

The first top panel 11 is foldably connected to a first top end flap 35 and a second top end flap 37 at respective longitudinal fold lines 39, 41. The first side panel 13 is foldably connected to a first side end flap 45 and a second side end flap 47 at respective longitudinal fold lines 49, 51. The bottom panel 19 is foldably connected to a first bottom end flap 55 and a second bottom end flap 57 at respective longitudinal fold lines 59, 61. The second side panel 25 is foldably connected to a first side end flap 65 and a second side end flap 67 at respective longitudinal fold lines 69, 71. The second top panel 31 is foldably connected to a first top end flap 75 and a second top end flap 77 at respective longitudinal fold lines 79, 81. In the illustrated embodiment, the first top panel 11 of the blank 1 has a first handle aperture, generally indicated at 85, and the second top panel 31 has a second handle aperture, generally indicated at 87.

In the illustrated embodiment, the first and second side end flaps 45, 47 of the first side panel 13 each have a respective adhesive flap 89, 91 connected to the side end flap at a respective longitudinal fold line 93, 95. In one embodiment, each of the first and second top end flaps 35, 37 include a respective intermediate longitudinal fold line 97, 99 spaced laterally from and generally parallel to the longitudinal fold lines 39, 41 to form a top corner panel 103, 105 of each top end flap. Similarly, the first and second top end flaps 75, 77 of the second top panel 31 each have a respective intermediate longitudinal fold line 107, 109 spaced laterally from and generally parallel to the longitudinal fold lines 79, 81 to form a respective top corner panel 111, 113. The first and second bottom end flaps 55, 75 each have a respective intermediate longitudinal fold line 117, 119 spaced laterally from and generally parallel to the longitudinal fold lines 59, 61 to form a bottom corner panel 121, 123 of each bottom end flap. As discussed below in more detail, the top corner panels 103, 105, 111, 113 form the top oblique corners 5 of the assembled carton 3 and the bottom corner panels 121, 123 form the bottom oblique corners of the assembled carton. It is understood, that the corner panels 103, 105, 111, 113, 121, 123 could be omitted from the blank 1 without departing from the scope of this invention. Further, the blank 1 could be configured such that longitudinal fold lines 39, 49, 59, 69, and 79 are replaced with a single, continuous longitudinal fold line and the longitudinal fold lines 41, 51, 61, 71, 81 are replaced with a single, continuous longitudinal fold line without departing from the scope of this invention.

The dispenser 7 includes a dispenser panel 127 removably attached to the carton blank 1. When the dispenser panel 127 is removed from the carton 3, a dispenser opening 129 (FIG. 7) of the dispenser 7 is exposed that allows the containers C to be selectively dispensed from the carton. As shown in FIG. 1, the dispenser panel 127 is defined in the blank 1 by a first tear line 131 extending laterally in the side flap 45 from the outer edge of the adhesive flap 89 to the longitudinal fold line 49, and a second curved tear line 133 spaced apart from the first tear line and extending generally laterally from the outer edge of the adhesive flap to the longitudinal fold line 49. In the illustrated embodiment, the second tear line 133 is curved so that the first and the second tear lines are spaced apart a greater longitudinal distance at the longitudinal fold line 49 than at the outer edge of the adhesive flap 89. A third tear line 135 extends generally laterally from the intersection of the first tear line 131 with the longitudinal fold line 49 into the first side panel 13 and intersects with a fourth tear line 137 located in the first side panel. A fifth tear line 141 extends obliquely from the intersection of the second tear line 133 with the longitudinal fold line 49 into the first side panel 13 and intersects with the fourth tear line 137. The fourth tear line 137 is generally arcuate and connects the third and fifth tear lines 135, 141 in the first side panel to define an edge of the dispenser 127 panel in the first side panel 13.

The dispenser 7 includes a sixth tear line 145 extending laterally in the side flap 65 from the outer edge of the flap to the longitudinal fold line 69, and a seventh curved tear line 147 spaced apart from the sixth tear line and extending generally laterally from the outer edge of the flap 65 to the longitudinal fold line 69. In the illustrated embodiment, the seventh tear line 147 is curved so that the sixth and seventh tear lines 145, 147 are spaced apart a greater longitudinal distance at the longitudinal fold line 69 than at the outer edge of the flap 65. An eighth tear line 149 extends generally laterally from the intersection of the sixth tear line 145 with the longitudinal fold line 69 into the second side panel 25 and intersects with a ninth tear line 151 located in the second side panel. A tenth tear line 153 extends generally obliquely from the intersection of the seventh tear line 147 with the longitudinal fold line 69 into the second side panel 25 and intersects with the ninth tear line 151. The ninth tear line 151 is generally arcuate and connects the eighth and tenth tear lines 149, 153 in the second side panel 25 to define an edge of the dispenser panel 127 in the second side panel. In the illustrated embodiment, the first, second, third, fourth, and fifth tear lines 131, 133, 135, 137, 141 define a first portion 157 of the dispenser panel 127 in the end flap 45 and side panel 13 that is a mirror image (as shown in FIG. 1 illustrating an unfolded blank 1) of a second portion 159 of the dispenser panel that is defined by the sixth, seventh, eighth, ninth, and tenth tear lines 145, 147, 149, 151, 153 in the side flap 65 and side panel 25.

The blank 1 includes a first access panel, generally indicated at 165, in the first side panel 13 and a second access panel, generally indicated at 167, in the second side panel 25. The first and second access panels 165, 167 allow the dispenser panel 127 to be grasped from either (or both) side edge(s) and removed from the carton 1.

Alternatively, the blank 1 may have only one of the first and second access panels 165, 167 without departing from the scope of this invention.

The first access panel 165 comprises an actuator panel 173 foldably connected to the side panel 13 by a longitudinal fold line 175 extending between the ends of the arcuate fourth tear line 137 that extend past the intersection with the respective third and fifth tear lines 135, 137. The access panel 165 includes two access flaps 181, 183 foldably connected to the actuator panel 173 by a first and second curved fold line 185, 187. A first end of each of the curved fold lines 185, 187 extends from a respective end of the longitudinal fold line 175 and a respective second end of the curved fold lines converge generally at the midpoint of the arcuate fourth tear line 137. As shown in FIG. 1, the two access flaps 181, 183 are generally petaloid in shape and are defined by a portion of the fourth arcuate tear line 137 and a respective curved fold line 185, 187.

The second access panel 167 in the second side panel 25 is constructed generally similar to the first access panel 165. The second access panel 165 includes an actuator panel 191 foldably connected to the side panel 25 by a longitudinal fold line 193 extending between the ends of the arcuate ninth tear line 151, and two petaloid access flaps 195, 197 foldably connected to the actuator panel 191 by a first and second curved fold line 201, 203.

The carton 3 may be erected from the blank 1 by first overlapping the first top panel 11 with the second top panel 31 and gluing or otherwise adhering the two top panels together so that the bottom panel 19, the first side panel 13, the adhered first and second top panels 11, 31, and the second side panel 25 may be opened or set up to form a generally tubular sleeve. The generally tubular sleeve may be closed, for example, by folding and adhering the end flaps 35, 45, 55, 65, 75 at one end of the carton 3 to form a first end panel, generally indicated at 207 (FIG. 2), and by folding and adhering the end flaps 37, 47, 57, 67, 77 at the other end of the carton to form a second end panel, generally indicated at 209. In the illustrated embodiment, the top oblique corners 5 of the carton 3 are formed when closing the end panels 207, 209 by downwardly folding the respective top end flaps 35, 75, 37, 77 about respective lateral fold lines 39, 41, 79, 81 to position the corner panels 103, 105, 111, 113 at oblique angles relative to adhered first and second top panels 11, 31, and downwardly folding the top end flaps about respective intermediate fold lines 103, 105, 107, 109. The bottom oblique corners 5 are formed by upwardly folding the respective bottom end flaps 55, 57 about respective lateral fold lines 59, 61 to position each bottom corner panel at an oblique angle relative to the bottom panel 19, and upwardly folding the bottom end flaps about respective intermediate fold lines 117, 119. The side flaps 45, 65 may then be overlapped to form the first closed end 207 of the carton 3, and the side flaps 47, 67 may be overlapped to form the second closed end 209 of the carton. Containers C or other articles, for example, may be loaded into the sleeve at any time before one or both ends 207, 209 of the carton 3 are closed by the end flaps 35, 45, 55, 65, 75 and/or the end flaps 37, 47, 57, 67, 77.

Figure 3:
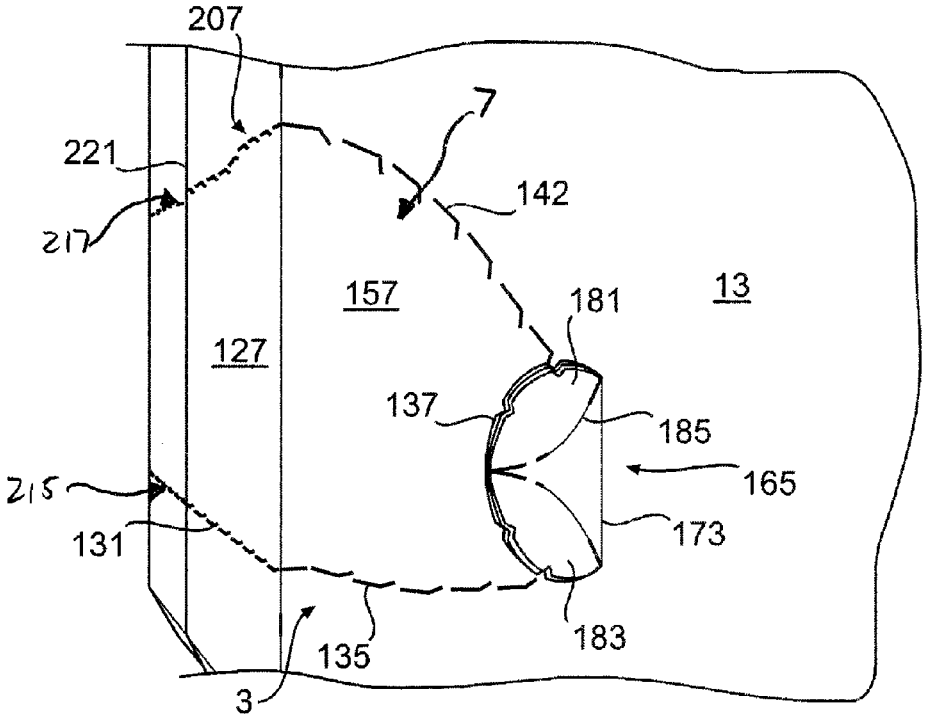
FIG. 3 is an enlarged portion of FIG. 2 showing an access panel being actuated.
Figure 4:
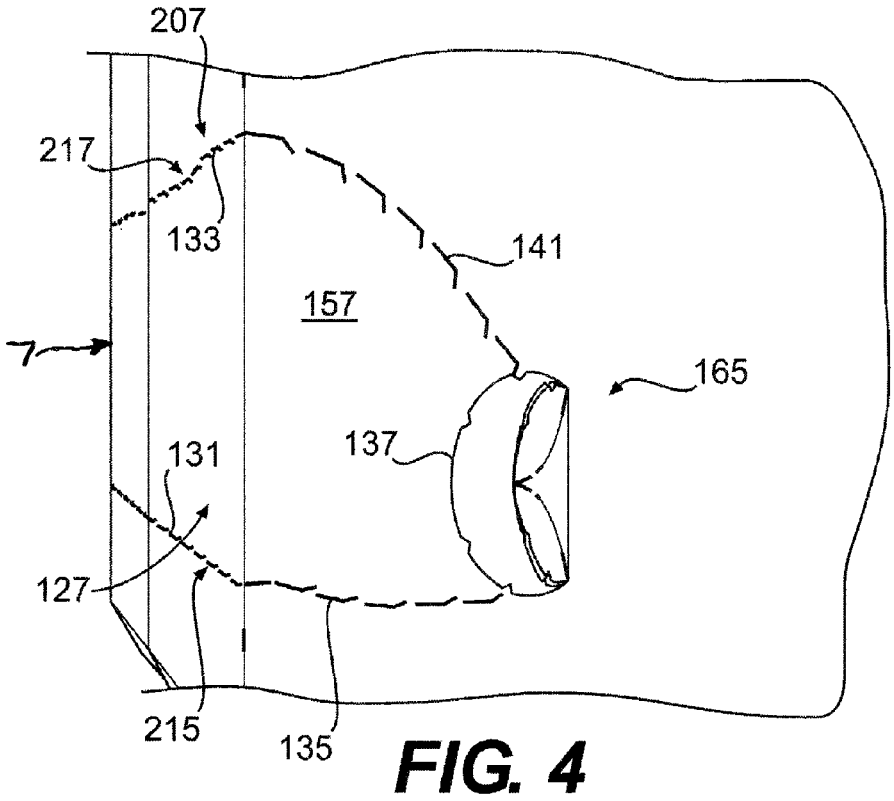
FIG. 4 is similar to FIG. 3 but showing the access panel fully actuated so that a dispenser panel may be grasped.
Figure 5:
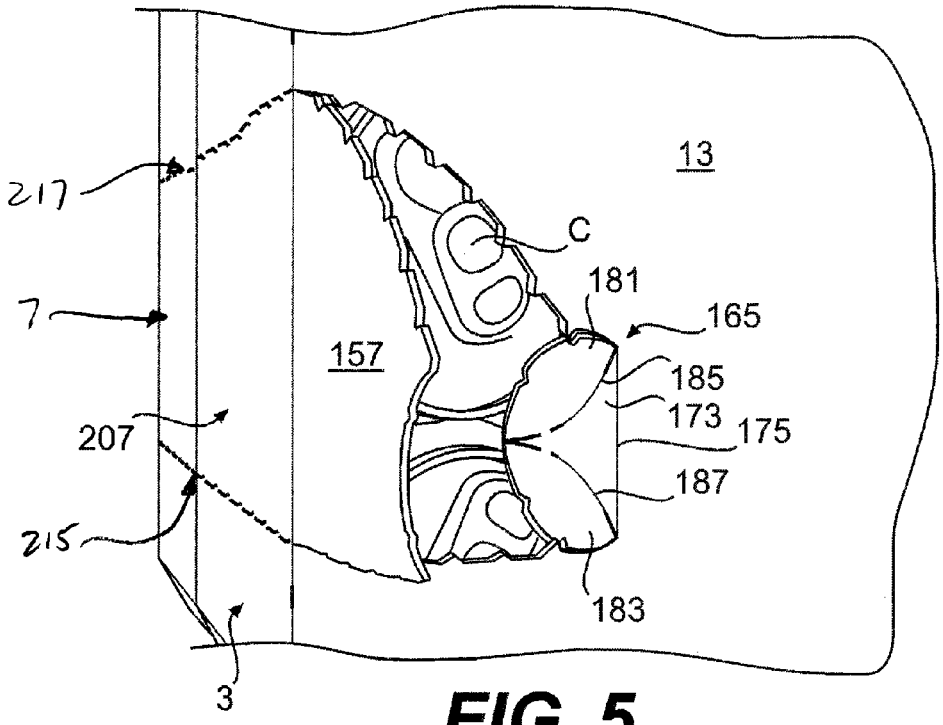
FIG. 5 is similar to FIG. 4 but showing the dispenser panel being removed from the carton.
Figure 6:
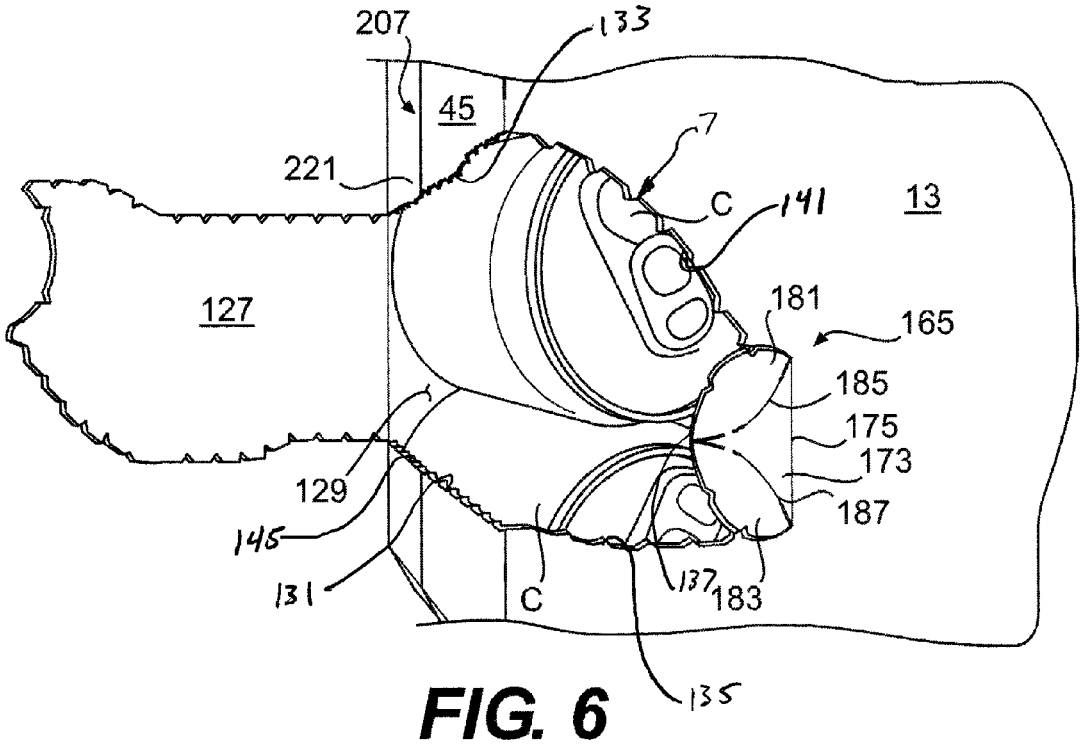
FIG. 6 is similar to FIG. 6 but showing further removal of the dispenser panel.
Figure 7:
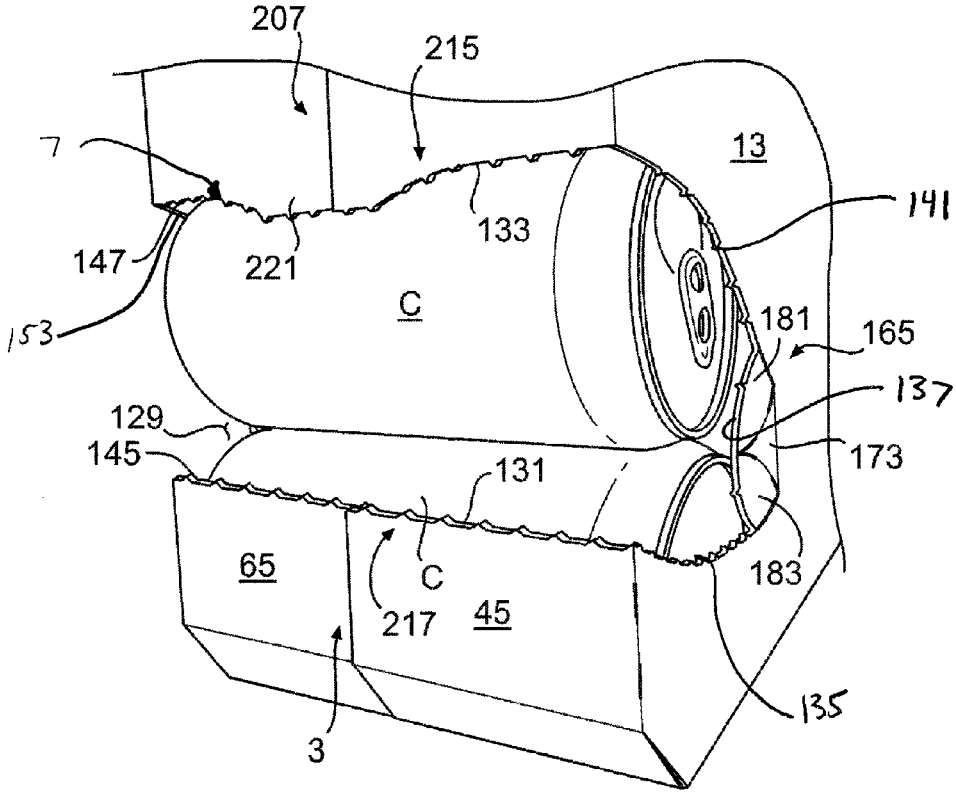
FIG. 7 is a detail perspective from one side of the carton with the dispenser panel removed, a perspective view from the other side being a mirror-image.
Figure 8:
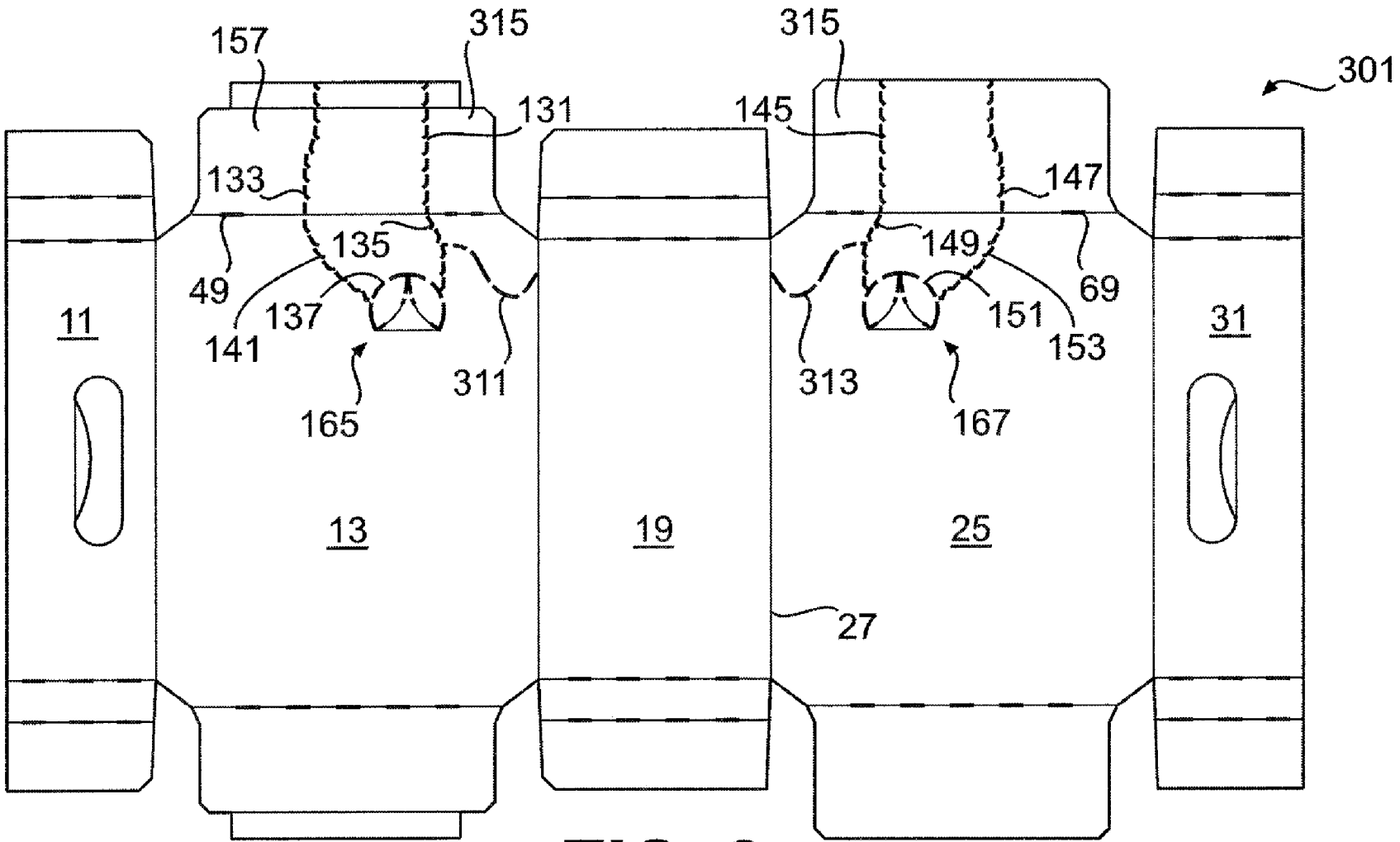
FIG. 8 is a plan view of a blank used to form a carton of a second embodiment of the invention.
Figure 9:
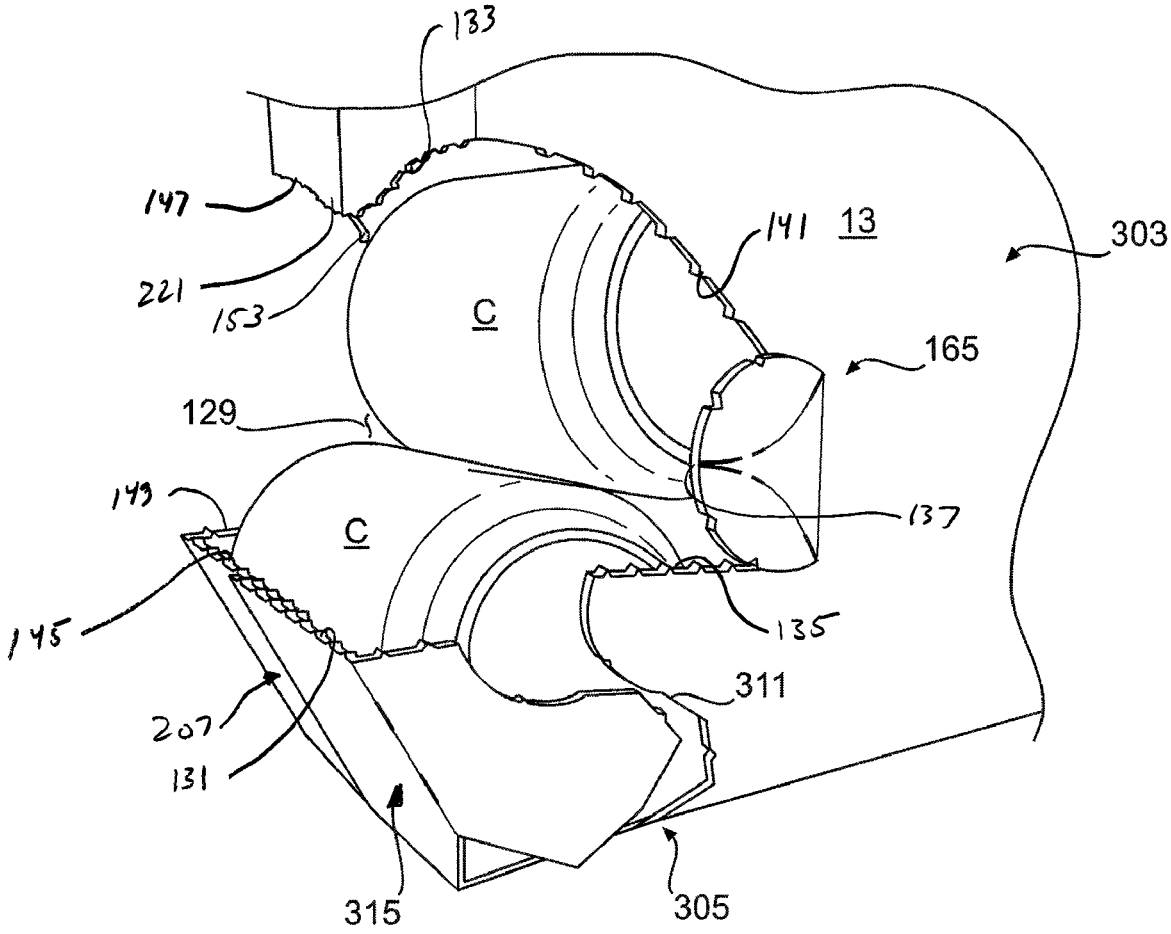
FIG. 9 is a detail view of a portion of the carton showing a dispenser panel removed from the carton, in accordance with the second embodiment.

FIG. 2 is a perspective view of the carton 3 erected from the blank 1 illustrated in FIG. 1 with containers C loaded and the first and second ends 207, 209 closed. As shown in FIGS. 3-7, and described in the following in accordance with one acceptable method, the dispenser 7 may be opened to allow containers C to be selectively dispensed from the carton 3 by removing the dispenser panel 127 to expose the dispenser opening 129. As shown in FIGS. 3-6, one side edge of the first portion 157 of the dispenser panel 127 may be exposed for grasping by a user by pressing on the first access panel 165 of the carton 3. As shown in FIGS. 3 and 4, pressure is applied to the actuator panel 173 to push the actuator panel inward and cause the access flaps 181, 183 to pivot outward about respective curved fold lines 185, 187. When the access flaps 181, 183 pivot, the flaps separate from (e.g., are struck from) the dispenser panel 127 along the arcuate fourth tear line 137. As shown in FIG. 5, after separating the access flaps 181, 183 from the dispenser panel 127, the edge of the first portion 157 of the dispenser panel is grasped by a user by inserting at least one finger between the edges of the access flaps and the edge of the dispenser panel. The dispenser panel 127 is removed by grasping the first portion 157 of the panel and pulling the edge of the dispenser panel in a direction to tear the panel along the third and fifth tear lines 135, 141 (FIG. 6) to begin removal of the dispenser panel from the carton. As shown in FIGS. 7 and 8, the dispenser panel 127 may be completely detached from the carton 3 by additional tearing along the first, second sixth, seventh, eighth, ninth, and tenth tear lines 131, 133, 145, 147, 149, 151, 153. As shown in FIG. 7, the access panel 165 typically remains attached to the side panel 13 along the fold line 175 after removal of the dispenser panel 127. The second access panel 167 remains attached to the side panel 25 upon removal of the second portion 159 of the dispenser panel 127 by tearing along the ninth tear line 151 at the other side (not shown) of the carton 3.

It is understood that the carton 3 is configured for either right or left hand removal of the dispenser panel 127 by allowing access to the dispenser panel from either the first or second access panel 165, 167. Further, the carton 3 may have only one access panel without departing from the scope of this invention. Also, the carton 3 may have a second dispenser (not shown) at the second end 209 of the carton without departing from the scope of this invention.

The first, third, sixth, and eighth tear lines 131, 135, 145, 149 of the dispenser 7 form a lower (first) tear line, generally indicated 215 (FIG. 2), in the closed end 207 of the carton 3, and the second, fifth, seventh, and tenth lines 133, 141, 147, 153 form an upper (second) tear line, generally indicated at 217, in the closed end of the carton. In accordance with the first embodiment, the top and bottom tear lines 215, 217 of the dispenser 7 are correspondingly spaced above the bottom panel 19 to prevent the containers C from rolling out of the dispenser opening 129 when the dispenser panel 127 is removed. For example, and in accordance with the first embodiment, the bottom tear line 215 is at a height H2 between approximately 40% and 80% of the diameter of the container C, as measured from the bottom panel 13, to prevent the bottom container from rolling out of the carton 3. In accordance with the first embodiment, the top tear line 217 in the closed end 207 is located at a height H1 equal to the diameter of the container C in the bottom row plus a distance that is less than the diameter of the container in the middle row to prevent the container in the middle row from rolling out of the carton 3. In one embodiment, the top tear line 217 is located at a height equal to the diameter of the container C in the bottom row plus a distance between approximately 60% and approximately 90% of the diameter of the container in the middle row.

In accordance with the first embodiment, the bottom tear line 215 and top tear line 217 are at sufficient heights to retain all the containers C in the carton 3 when the dispenser panel 127 is removed, and the tear lines are spaced apart a sufficient distance to allow easy removal of the containers by grasping the container to be removed at both axial ends. The curvature of the top tear line 217 facilitates holding the containers C in the carton 3 and grasping the container to be removed. The top tear line 217 has a lower portion near the centerline of the closed end 207 that forms a lip 221 that tends to increase the retaining force of the carton 3. In the illustrated embodiment, the lip 221 is generally centrally located in the closed end 207 of the carton 3 such that the lip is downwardly extending in the middle of the dispenser opening 129. The top tear line 217 curves upward from the lip 221 to the respective side panels 13, 25 to allow increased exposure of the ends of the container C for grasping of the container. The height H1 of the top tear line 217 is measured from the low point of the tear line forming the lip 221. It is understood that the bottom tear line 215 could also be curved without departing from the scope of this invention.

As shown in FIG. 7, the edges of the dispenser opening 129 in the carton 3 correspond to the shape of the tear lines 131, 133, 135, 137, 141, 145, 147, 149, 151, 153 of the dispenser 7. The dispenser opening 129 is shaped so that the lip 221 retains the middle or second row of containers C in the 3×4 arrangement of the illustrated embodiment. The dispenser opening 129 is also shaped to allow access to the exposed container C of the second row at the side panels 13, 25 so the exposed second row container can be grasped and removed through the dispenser opening. The dispenser 7 and/or carton 3 could be otherwise shaped and arranged, including a shape that retains other rows or columns of containers, without departing from the invention.

As shown in FIG. 2, the upper and lower tear lines are spaced apart a minimum distance D1 of approximately 2.3 inches (58 mm) and a maximum distance D2 of approximately 2.6 inches (66 mm). In the illustrated embodiment, the minimum distance D1 is located at approximately the low point of the lip 221 in the end 207 of the carton 5 and the maximum distance D2 is located to either side of the lip near the fold line 49, 69 respectively connecting the end flap 45, 65 to the side panels 13, 25. The height H1 may be at least approximately 4.6 inches (117 mm). In one embodiment, the height H2 may be at least approximately 2.3 inches (66 mm); and the containers C may have a diameter of at least approximately 2½ inches (63 mm). The upper and lower tear lines may be alternatively shaped and arranged without departing from the invention. It is understood that the dimensional information provided herein, including but not limited to the minimum distance D1 and maximum distance D2, is exemplary only, may be more or less than the dimensions listed herein, and is not intended to limit the scope of the invention.

FIG. 8 shows a blank, generally indicated 301, for forming a carton, generally indicated 303, of a second embodiment of the invention. The carton 303 of the second embodiment is substantially similar to the carton 3 of the first embodiment except the carton 303 includes a hinge, generally designated 305 (FIG. 10) that allows the dispenser opening 129 to be expanded to facilitate access to the containers C. Accordingly, like reference numbers have been used to indicate similar or identical features in the first and second embodiment. The hinge includes a first curved tear line 311 in the blank 301 that extends from the third tear line 135 of the dispenser 7 to the lateral fold line 21, and a second curved tear line 313 that extends from the eighth tear line 149 of the dispenser to the lateral fold line 27. The first and second curved tear lines 311, 313 and the first, third, sixth and eight tear lines 131, 135, 141, 149 of the dispenser 7 define a pivotable flap 315 of the carton 303. In the illustrated embodiment the pivotable flap 315 comprises at least a portion of the side end flaps 45, 64, the first side panel 13, and second side panel 25. The pivotable flap 315 could be otherwise shaped and arranged without departing from the invention.

The dispenser panel 127 may be removed from the carton 303 in a similar manner as discussed above for the first embodiment. After removal of the dispenser panel 127 to expose the dispenser opening 129, the pivotable flap 315 may be grasped and pulled outward away from the interior of the carton 303 so that the flap pivots about the respective first and second curved lines 311, 313 of the hinge 305. The hinge 305 allows movement of the pivotable flap 315 to allow the dispenser opening 129 to be enlarged to facilitate access to the containers C in the carton. In particular, the pivotable flap 315 can be pivoted downward to expand the dispenser opening 129 allowing the bottom container C to be easily grasped and removed from the container 303.

The present invention can be used in cartons that include various features, including additional opening features that provide easy access to the articles, and tilt features that position the articles at the front or rear end of the carton.

The blank according to any of the embodiments of the present invention can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described above. The blank can also be laminated to or coated with one or more sheet-like materials at selected panels or panel sections.

The term "line" as used herein includes not only straight lines, but also other types of lines such as curved, curvilinear or angularly displaced lines.

The above embodiments are described as having one or more panels adhered together by glue. The term "glue" is intended to encompass all manner of adhesives commonly used to secure carton panels in place.

In accordance with the exemplary embodiments, a fold line can be any substantially linear, although not necessarily straight, form of weakening that facilitates folding thereal-ong. More specifically, but not for the purpose of narrowing the scope of the present invention, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present invention for each of the tear lines to be replaced with a continuous slit, or the like. For example, a cut line can be a continuous slit or could be wider than a slit without departing from the present invention.

The foregoing description of the invention illustrates and describes various embodiments of the present invention. As various changes could be made in the above construction without departing from the scope of the invention, it is intended that all matter contained in the above description or shown in the accompanying drawings shall be interpreted as illustrative and not in a limiting sense. Furthermore, the scope of the present invention covers various modifications, combinations, alterations, etc., of the above-described embodiments that are within the scope of the claims. Additionally, the disclosure shows and describes only selected embodiments of the invention, but the invention is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the invention without departing from the scope of the invention.

What is claimed is:

1. A carton for containing a plurality of articles, the carton comprising:

a plurality of panels that extends at least partially around an interior of the carton, the plurality of panels comprises a top panel, a bottom panel, a first side panel, and a second side panel;

at least two end flaps respectively foldably attached to respective panels of the plurality of panels, wherein the end flaps are overlapped with respect to one another and thereby at least partially close an end of the carton; and a dispenser for allowing removal of articles from the carton, the dispenser comprising a dispenser panel that is at least partially defined by a tear line in the carton and is for being at least partially removed for at least further opening a dispenser opening, the dispenser panel having an edge in at least one of the side panels, in the closed end, the tear line comprises an upper tear line and a lower tear line, the upper and lower tear lines being spaced apart and respectively extending across the closed end; and an access panel in at least one of the side panels and adjacent the edge for being inwardly folded to initiate grasping of the edge and removal of the dispenser panel, wherein the access panel comprises an actuator panel foldably connected to one of the first and second side panels and the access panel comprises two access flaps foldably connected to the actuator panel at respective fold lines, the access flaps being separable from the dispenser panel by at least a portion of the tear line.

2. The carton of claim 1 wherein the at least two end flaps comprise a first side end flap foldably attached to the first side panel and a second side end flap foldably attached to the second side panel.

3. The carton of claim 2 wherein the dispenser panel includes a portion of the first side panel, a portion of the second side panel, a portion of the first side end flap, and a portion of the second side end flap.

4. The carton of claim 1 wherein the dispenser comprises a hinge and a pivotable flap for enlarging the dispenser opening.

5. The carton of claim 4 wherein the pivotable flap comprises a curved tear line in each of the first side panel and the second side panel.

6. The carton of claim 5 wherein the pivotable flap comprises at least a portion of the closed end, a portion of the first side panel, and a portion of the second side panel.

7. The carton of claim 1 wherein the access flaps are generally petaloid-shaped.

8. The carton of claim 1 further comprising a handle in the top panel for grasping and carrying the carton.

9. The carton of claim 1 in combination with a plurality of articles, the plurality of articles comprising containers that are arranged in at least two rows in the carton.

10. The carton of claim 1 wherein the access panel is non-removably attached to the at least one side panel.

11. The carton of claim 1, wherein at least a portion of the actuator panel is spaced apart from the dispenser panel by the two access flaps.

12. The carton of claim 1, wherein the actuator panel is connected to at least one of the first and second side panels at an actuator fold line that is spaced apart from the dispenser panel.

13. The carton of claim 12, wherein each of the two access flaps is connected to the actuator panel at a curved fold line extending from and end of the actuator fold line.

14. A carton for containing a plurality of articles, the carton comprising:

a plurality of panels that extends at least partially around an interior of the carton, the plurality of panels comprises a top panel, a bottom panel, a first side panel, and a second side panel;

at least two end flaps respectively foldably attached to respective panels of the plurality of panels, wherein the end flaps are overlapped with respect to one another and thereby at least partially close an end of the carton; and a dispenser for allowing removal of articles from the carton, the dispenser comprising a dispenser panel that is at least partially defined by a tear line in the carton and is for being at least partially removed for at least further opening a dispenser opening, the dispenser panel having an edge in at least one of the side panels, in the closed end, the tear line comprises an upper tear line and a lower tear line, the upper and lower tear lines being spaced apart and respectively extending across the closed end, wherein the upper tear line is curved and forms a downwardly protruding lip in the closed end; and an access panel in at least one of the side panels and adjacent the edge for being inwardly folded to initiate grasping of the edge and removal of the dispenser panel, wherein the access panel comprises an actuator panel foldably connected to one of the first and second side panels and the access panel comprises two access flaps foldably connected to the actuator panel at respective fold lines, the access flaps being separable from the dispenser panel by at least a portion of the tear line.

15. The carton of claim 14 wherein the lip is centrally located in the closed end.

16. The carton of claim 14 wherein the lower tear line is generally straight.

17. The carton of claim 16 wherein the lower tear line is spaced apart from the upper tear line by a minimum distance of at least approximately 2 inches.

18. A carton for containing a plurality of articles, the carton comprising:

a plurality of panels that extends at least partially around an interior of the carton, the plurality of panels comprises a top panel, a bottom panel, a first side panel, and a second side panel;

at least two end flaps respectively foldably attached to respective panels of the plurality of panels, wherein the end flaps are overlapped with respect to one another and thereby at least partially close an end of the carton; and a dispenser for allowing removal of articles from the carton, the dispenser comprising a dispenser panel that is at least partially defined by a tear line in the carton and is for being at least partially removed for at least further opening a dispenser opening, the dispenser panel having an edge in at least one of the side panels, in the closed end, the tear line comprises an upper tear line and a lower tear line, the upper and lower tear lines being spaced apart and respectively extending across the closed end; and an access panel in at least one of the side panels and adjacent the edge for being inwardly folded to initiate grasping of the edge and removal of the dispenser panel, wherein the access panel comprises an actuator panel foldably connected to one of the first and second side panels and the access panel comprises two access flaps foldably connected to the actuator panel at respective fold lines, the access flaps being separable from the dispenser panel by at least a portion of the tear line, wherein the end flaps comprise a top end flap and a bottom end flap, the top end flap having a top corner panel foldably attached to the top end flap and the bottom end flap having a bottom corner panel foldably attached to the bottom end flap.

19. The carton of claim 18 wherein the top corner panel forms a top oblique corner at the closed end of the carton, and the bottom corner panel forms a bottom oblique corner at the closed end of the carton.

20. A blank for forming a carton comprising:

a plurality of panels, the plurality of panels comprises a top panel, a bottom panel, a first side panel, and a second side panel;

at least two end flaps respectively foldably attached to respective panels of the plurality of panels;

dispenser features comprising at least one dispenser panel that is at least partially defined by a tear line for at least partially separating the dispenser panel from the blank, the dispenser panel having an edge in at least one of the side panels;

the tear line comprises two spaced apart tear lines in the at least two end flaps, the two tear lines respectively extending across the at least two end flaps; and an access panel in at least one of the side panels and adjacent the edge for being inwardly folded to initiate grasping of the edge and removal of the dispenser panel, wherein the access panel comprises at least one actuator panel foldably connected to one of the first and second side panels and the access panel comprises two access flaps foldably connected to the actuator panel at respective fold lines, the access flaps being separable from the dispenser panel by at least a portion of the tear line.

21. The blank of claim 20 wherein the at least two end flaps comprise a first side end flap foldably attached to the first side panel and a second side end flap foldably attached to the second side panel.

22. The blank of claim 21 wherein the dispenser panel includes a portion of the first side panel, a portion of the second side panel, a portion of the first side end flap, and a portion of the second side end flap.

23. The blank of claim 20 wherein the dispenser features further comprise a hinge and a pivotable flap, the pivotable flap comprises a curved tear line in each of the first side panel and the second side panel.

24. The blank of claim 23 wherein the pivotable flap comprises at least a portion of the side end flaps, a portion of the first side panel, and a portion of the second side panel.

25. The blank of claim 20 wherein the access flaps are generally petaloid-shaped.

26. The blank of claim 20, wherein at least a portion of the actuator panel is spaced apart from the dispenser panel by the two access flaps.

27. The blank of claim 20, wherein the actuator panel is connected to at least one of the first and second side panels at an actuator fold line that is spaced apart from the dispenser panel.

28. The blank of claim 27, wherein each of the two access flaps is connected to the actuator panel at a curved fold line extending from and end of the actuator fold line.

29. A blank for forming a carton comprising:

a plurality of panels, the plurality of panels comprises a top panel, a bottom panel, a first side panel, and a second side panel;

at least two end flaps respectively foldably attached to respective panels of the plurality of panels;

dispenser features comprising at least one dispenser panel that is at least partially defined by a tear line for at least partially separating the dispenser panel from the blank, the dispenser panel having an edge in at least one of the side panels;

the tear line comprises two spaced apart tear lines in the at least two end flaps, the two tear lines respectively extending across the at least two end flaps, wherein one of the two spaced-apart tear lines is curved and the other of the spread-apart tear lines is generally straight; and an access panel in at least one of the side panels and adjacent the edge for being inwardly folded to initiate grasping of the edge and removal of the dispenser panel, wherein the access panel comprises at least one actuator panel foldably connected to one of the first and second side panels and the access panel comprises two access flaps foldably connected to the actuator panel at respective fold lines, the access flaps being separable from the dispenser panel by at least a portion of the tear line.

30. The blank of claim 29 wherein the tear lines are spaced apart by a minimum distance of at least approximately 2 inches.

31. A method of opening a carton comprising:

providing a carton having a plurality of panels that extends at least partially around an interior of the carton, the plurality of panels comprises a top panel, a bottom panel, a first side panel, a second side panel, and end flaps respectively foldably attached to respective panels of the plurality of panels, wherein the end flaps are overlapped with respect to one another and thereby at least partially form a closed end of the carton, a dispenser comprising a dispenser panel at least partially defined by a tear line in the carton, the tear line comprising an upper tear line and a spaced-apart lower tear line, each of the upper and lower tear lines extending across the closed end, the dispenser panel having an edge in at least one of the site panels and an access panel in at least one of the side panels and adjacent the edge, the actuator panel being foldably connected to at least one of the first and second side panels;

inwardly folding the access panel to allow access to the dispenser panel, wherein the inwardly folding of the access panel comprises inwardly folding an actuator panel to separate two access flaps from the dispenser panel at the edge along at least a portion of the tear line;

grasping the edge of the dispenser panel and at least partially separating the dispenser panel from the carton by at least partially tearing the carton along the upper and lower tear lines to create a dispenser opening in the carton.

32. The method of claim 31 further comprising removing a container from the carton through the dispenser opening.

33. The method of claim 31 further comprising expanding the dispenser opening by pivoting a pivotable flap to increase the size of the dispenser opening in the carton.

34. The method of claim 33 wherein the pivotable flap comprises a curved tear line in each of the first side panel and the second side panel, and wherein the pivoting of the dispenser section comprises separating the pivotable flap along the curved tear lines.

35. The method of claim 31 wherein the carton comprises at least one tear line in the first side panel and at least one tear line in the second side panel, wherein the dispenser opening is created by tearing the carton along the tear lines in the first side panel and the second side panel.

* * * * *